US010410570B2

(12) United States Patent
Tang et al.

(10) Patent No.: US 10,410,570 B2
(45) Date of Patent: Sep. 10, 2019

(54) LIGHT EMITTING DIODE DISPLAY DEVICE AND METHOD FOR IMPROVING IMAGE QUALITY USING SCHEME OF DIVIDING FRAMES INTO SUBFRAMES

(71) Applicant: Chipone Microelectronics Technology (Hefei) Co., Beijing (CN)

(72) Inventors: Yongsheng Tang, Beijing (CN); Yong Wang, Beijing (CN); Haifeng Liu, Beijing (CN); Xingbo Gao, Beijing (CN)

(73) Assignee: Chipone Microelectronics Technology (Hefei) Co., Beijing (CN)

( * ) Notice: Subject to any disclaimer, the term of this patent is extended or adjusted under 35 U.S.C. 154(b) by 90 days.

(21) Appl. No.: 15/690,673

(22) Filed: Aug. 30, 2017

(65) Prior Publication Data

US 2018/0293927 A1 Oct. 11, 2018

(30) Foreign Application Priority Data

Apr. 7, 2017 (CN) ..... 2017 1 0225084

(51) Int. Cl.
*G09G 3/20* (2006.01)
*G09G 3/32* (2016.01)

(52) U.S. Cl.
CPC ..... *G09G 3/204* (2013.01); *G09G 3/32* (2013.01); *G09G 2300/026* (2013.01);
(Continued)

(58) Field of Classification Search
CPC .... G09G 3/204; G09G 3/32; G09G 2310/027; G09G 2310/08; G09G 2320/0242
See application file for complete search history.

(56) References Cited

U.S. PATENT DOCUMENTS

2011/0080173 A1* 4/2011 Kim ..... G09G 3/006 324/403
2013/0141469 A1* 6/2013 Xu ..... G09G 3/3233 345/690

(Continued)

FOREIGN PATENT DOCUMENTS

CN 206134209 U 4/2017

*Primary Examiner* — Kwang-Su Yang
(74) *Attorney, Agent, or Firm* — James M. Wu; JW Law Group

(57) ABSTRACT

The present disclosure relates to the technical field of LED display screens, and in particular, to an LED display device and a method for driving the same. The driving method includes: generating a grayscale data in accordance with an image to be displayed; generating a control signal in accordance with the grayscale data, wherein the control signal includes a plurality of subframe signals each having a duration corresponding to a respective subframe display time; and controlling the corresponding LED lamps to be turned on or off by use of the subframe signals in each subframe of the frame cycle. The frame cycle includes reset time periods separating the successive subframes from each other. The order of the plurality of subframes in the frame cycle can be adjusted by use of the grayscale data. The LED display device and the driving method for the LED display device according to the disclosure can divide each frame cycle into a plurality of subframes and adjust the subframe display time to eliminate parasitic effects between the LED display unit boards, so as to eliminate the color difference between the LED display unit boards.

11 Claims, 4 Drawing Sheets

(52) U.S. Cl.
CPC ... *G09G 2310/027* (2013.01); *G09G 2310/08* (2013.01); *G09G 2320/0233* (2013.01); *G09G 2320/0242* (2013.01)

(56) References Cited

U.S. PATENT DOCUMENTS

2015/0187252 A1* 7/2015 Ishii ..... G09G 3/2022
345/690
2016/0189597 A1* 6/2016 Park ..... G09G 3/20
345/694
2017/0026600 A1* 1/2017 Noh ..... H04N 5/378

* cited by examiner

LIGHT EMITTING DIODE DISPLAY DEVICE AND METHOD FOR IMPROVING IMAGE QUALITY USING SCHEME OF DIVIDING FRAMES INTO SUBFRAMES

CROSS-REFERENCE TO RELATED APPLICATION

This application claims the benefit of Chinese Patent Application No. 201710225084.2, filed on Apr. 7, 2017, which is incorporated herein by reference in its entirety.

BACKGROUND OF THE DISCLOSURE

Field of the Disclosure

The present disclosure is related to the technical field of LED display screens, and in particular, to an LED display device and a method for driving the same.

Background of the Disclosure

A Light-Emitting Diode (LED) display screen, composed of LED display unit boards, is a modern information announcing platform. Due to the advantages of high luminous efficiency, long service life, flexible configuration, rich colors and indoor and outdoor environmental adaptability, the LED display screen has been gradually accepted by the market, in particular, the full-color LED display screen develops rapidly and has been widely used in the fields of traffic electronic identification, urban media, etc.

The composition characteristic of LED display screen is modularization, that is, an LED display screen can be combined by a large number of LED display unit boards which are also known as LED display modules. The LED display unit boards in the same LED display screen are different in performance to some extent due to their different processes, materials and the like. So, when an image with gradually changing colors is displayed by the LED display screen assembled by the LED display unit boards, especially the LED display screen driven by Pulse Width Modulation (PWM) constant power source, the LED display unit boards displaying low overall grayscales will become comparatively dark and the LED display unit boards displaying high overall grayscales will become comparatively bright, leading to display problems. As a result, there are apparent boundary lines at the splice portion of two LED display unit boards. The display of grayscale is an important factor affecting the display effect of the LED display screen and is difficult to be controlled. The color difference between the LED display unit boards can affect the display effect of the LED display screen.

SUMMARY OF THE DISCLOSURE

In view of this, the disclosure is to provide an LED display device and a driving method for the LED display device. The driving method divides each frame cycle into a plurality of subframes and adjusts the subframe display time to eliminate parasitic effects between the LED display unit boards, so as to eliminate the color differences between the LED display unit boards.

According to a first aspect of the disclosure, there is provided the driving method for the LED display device, the LED display device includes a plurality of LED display unit boards, wherein each of the LED display unit boards is configured to display an image at a predetermined frame cycle, the frame cycle includes a plurality of subframes, each of the plurality of subframes having a respective subframe display time, the driving method includes: generating a grayscale data in accordance with an image to be displayed; generating a control signal in accordance with the grayscale data, wherein the control signal comprises a plurality of subframe signals each having a duration corresponding to a respective subframe display time; and turning on or off LED lamps arranged on each of the LED display unit boards by use of the plurality of subframe signals in each subframe of the frame cycle, wherein the frame cycle includes a reset time period between successive subframes of the plurality of subframes, and an order of the plurality of subframes in the frame cycle is adjusted in accordance with the grayscale data.

Preferably, the plurality of subframes are arranged by their subframe display times from the smallest to the largest in a predetermined order.

Preferably, when a grayscale represented by the grayscale data is equal to or smaller than a first threshold value, the plurality of subframes arranged in the predetermined order are sequentially displayed in the frame cycle.

Preferably, when the grayscale represented by the grayscale data is larger than the first threshold value, the order of at least some of the plurality of subframes is adjusted randomly to form the plurality of subframes arranged in an adjusted order.

Preferably, the driving method further comprises: randomly generating an indication data in accordance with the grayscale data, wherein the indication data represents the order of at least some of the plurality of subframes.

Preferably, the grayscale data and the indication data are combined into a display data by a control terminal.

Preferably, the indication data is a binary value formed by at least one bit of the display data for indicating various adjusted orders.

Preferably, said control signal is a PWM signal.

According to a second aspect of the disclosure, there is provided an LED display device, comprising: a data processing module configured to generate a grayscale data in accordance with an image to be displayed; a plurality of LED display unit boards configured to the display the images at a predetermined frame cycle, the frame cycle comprises a plurality of subframes, each of the plurality of subframes having a respective subframe display time, each of the LED display unit boards comprises: a plurality of row lines and a plurality of column lines; a row driver being coupled to the plurality of row lines, and configured to provide a selecting signal; a column driver being coupled to the plurality of column lines, and configured to adjust an order of the plurality of subframes in the frame cycle in accordance with the grayscale data and generate a control signal in accordance with the grayscale data, wherein the control signal comprises a plurality of subframe signals each having a duration corresponding to a respective subframe display time; a plurality of pixel units, wherein each of the plurality of pixel units comprises an LED lamp being coupled to one of the plurality of row lines and one of the plurality of column lines, wherein each LED lamp corresponding to a respective pixel unit is turned on or off in accordance with the plurality of subframe signals, wherein the frame cycle includes a reset time period between successive subframes of the plurality of subframes.

Preferably, the column driver is configured to arrange the plurality of subframes by their subframe display times from the smallest to the largest in a predetermined order by default.

Preferably, the column driver is configured to generate the control signal in the predetermined order in the frame cycle, when a grayscale represented by the grayscale data is equal to or smaller than the first threshold value.

Preferably, the column driver is configured to adjust the order of at least some of the plurality of subframes randomly to generate the control signal in accordance with an adjusted order, when a grayscale represented by the grayscale data is larger than the first threshold value.

Preferably, the column driver is configured to adjust the order of at least some of the plurality of subframes randomly to generate the control signal in accordance with an adjusted order, when a grayscale represented by the grayscale data is larger than the first threshold value.

Preferably, the data processing module is further configured to combine the indication data and the grayscale data into a display data, the indication data is a binary value formed by at least one bit of the display data.

Preferably, the column driver is further configured to obtain various adjusted orders in accordance with the indication data of the display data.

Preferably, said control signal is a PWM signal.

According to a third aspect of the disclosure, there is provided a non-transient computer-readable storage medium on which computer instructions for performing the driving method provided according to the first aspect of the disclosure is stored.

In the embodiments of the disclosure, by dividing each frame cycle into a plurality of subframes and adjusting the subframe display time, the parasitic effect between the LED display unit boards is eliminated, such that the color difference between the LED display unit boards is eliminated.

BRIEF DESCRIPTION OF THE DRAWINGS

The above and other objects, advantages and features of the present invention will become more fully understood from the detailed description given below in connection with the appended drawings, and wherein.

DETAILED DESCRIPTION OF THE DISCLOSURE

Figure 1:
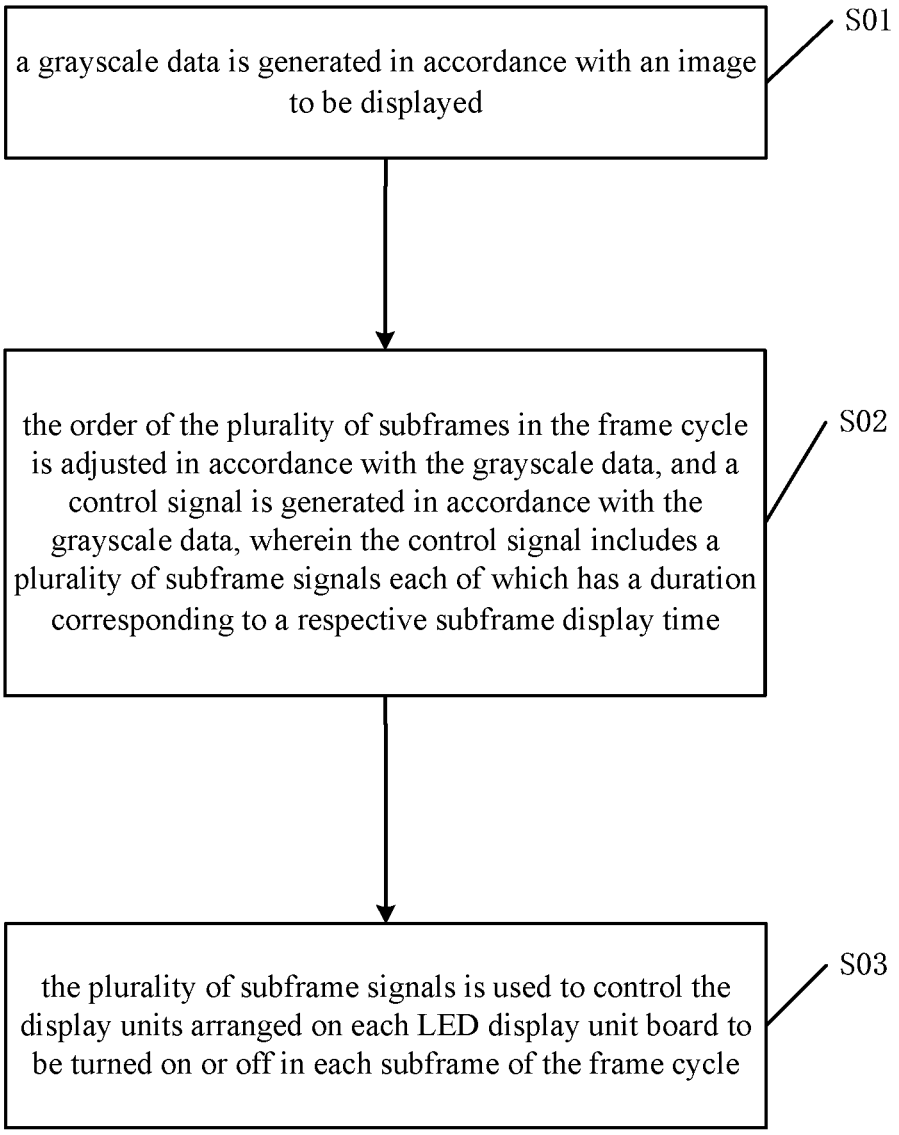
FIG. 1 is a flow diagram of a driving method for an LED display device according to an embodiment of the disclosure.

Exemplary embodiments of the present disclosure will be described in more details below with reference to the accompanying drawings. In the drawings, like reference numerals denote like members. The figures are not drawn to scale, for the sake of clarity. Moreover, some well-known parts may not be shown in the figures.

FIG. 1 is a flow diagram of a driving method for an LED display device according to an embodiment of the disclosure. The LED display device includes a plurality of LED display unit boards, each of the LED display unit boards is configured to display an image at a predetermined frame cycle. Each frame cycle includes a plurality of subframes, each of the plurality of subframes has a respective subframe display time.

At step S01, a grayscale data is generated in accordance with an image to be displayed.

At step S02, the order of the plurality of subframes in the frame cycle is adjusted in accordance with the grayscale data, and a control signal is generated in accordance with the grayscale data, wherein the control signal includes a plurality of subframe signals each of which has a duration corresponding to a respective subframe display time. In some embodiments, the control signal may be a PWM signal.

In the frame cycle, the cumulative effective time of the control signal is consistent with the grayscale data. Reset time periods are included between the successive subframes of the plurality of subframes in the frame cycle, and the reset time periods separate the successive subframes from each other.

In some embodiments, the plurality of subframes may be arranged in a predetermined order, for example, in an increasing order of subframe display time. When a grayscale represented by the grayscale data is equal to or smaller than a first threshold value, the plurality of subframes arranged in the predetermined order are sequentially displayed in the frame cycle. When the grayscale represented by the grayscale data is larger than the first threshold value, the order of at least some of the plurality of subframes may be adjusted randomly to form the plurality of subframes arranged in an adjusted order.

In some embodiments, an indication data may also be generated in accordance with the grayscale data, and the indication data may be configured to represent the order of at least some of the plurality of subframes. A control terminal can be used to combine the grayscale data and the indication data into a display data. The indication data may be a binary value formed by at least one arbitrary bit of the display data for indicating various adjusted orders. For example, the indication data may be a binary value formed by two least significant digits of the display data, and thus may be used to indicate four adjusted orders.

At step S03, the plurality of subframe signals are used to control the LED lamps to be turned on or off in each subframe of the frame cycle.

Figure 4:
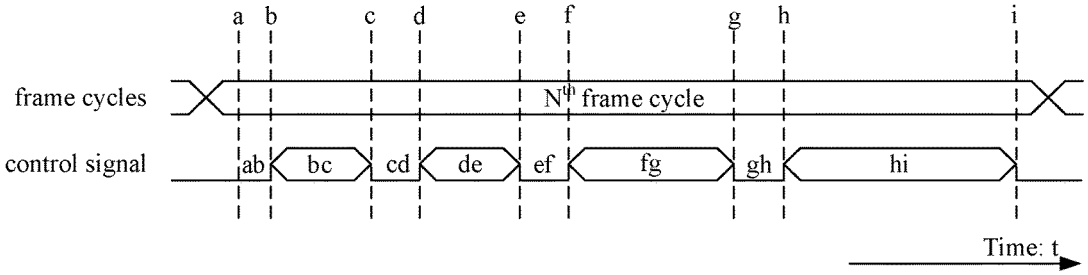
FIG. 4 is a timing diagram of a control signal according to an embodiment of the disclosure.

FIG. 4 is a timing diagram of the control signal according to an embodiment of the disclosure. As to a frame cycle for the $N^{th}$ frame (N>0, i.e., N is a positive integer representing the current frame cycle), the scanning time period corresponding to the $N^{th}$ frame may be divided into subframe display time periods and reset time periods in time domain. As an example, it may be divided into four subframe display time periods, i.e. periods bc, de, fg and hi. During the time periods bc, de, fg and hi, the LED lamp corresponding to each of the pixels is turned on under the control of the plurality of subframe signals included in the control signal, each of which having a duration corresponding to a respective subframe display time. The periods ab, cd, df and gh are reset time periods, during which the LED lamp corresponding to each of the pixels is reset. The length of the periods bc, de, fg and hi can be determined in accordance with the grayscale data. In accordance with the grayscale data, the $N^{th}$ frame can be divided into four subframes, i.e. a first subframe, a second subframe, a third subframe and a fourth subframe, and the periods bc, de, fg and hi may be used for displaying the four subframes. An indication data representing the order of the four subframes can be generated in accordance with the grayscale data, and a control terminal may be used to combine the grayscale data and the indication data into the display data. As an example, the indication data can be a binary value formed by two least significant digits of the display data, by which four adjusted orders may be indicated. For example, when the two least significant digits are 00, the frame image is displayed in the order which takes the first subframe first, then the second subframe, the third subframe and the fourth subframe last; when the digits are 01, the frame image is displayed in the order which takes the fourth subframe first, then the first subframe, the second subframe and the third subframe last; when the digits are 10, the frame image is displayed in the order which takes the third subframe first, then the fourth subframe, the first subframe and the second subframe last; and when the digits are 11, the frame image is displayed in the order which takes the second subframe first, then the third subframe, the fourth subframe and the first subframe last. It should be noted that the above is only used as an example, the manner in which the control signal in the current frame cycle is divided into subframe display time periods and reset time periods in time domain is not limited to the above example. The scanning time period of one frame cycle can be divided into multiple subframe display time periods in time domain, which is not limited to four periods. The length of one subframe display time can be equal or unequal to another. Also, the number of the adjusted orders for indication is not limited to four, and it can be determined by the bit number and/or position of the binary value of the indication data. Specific adjusted orders can also be designed in more diverse ways.

Figure 2:
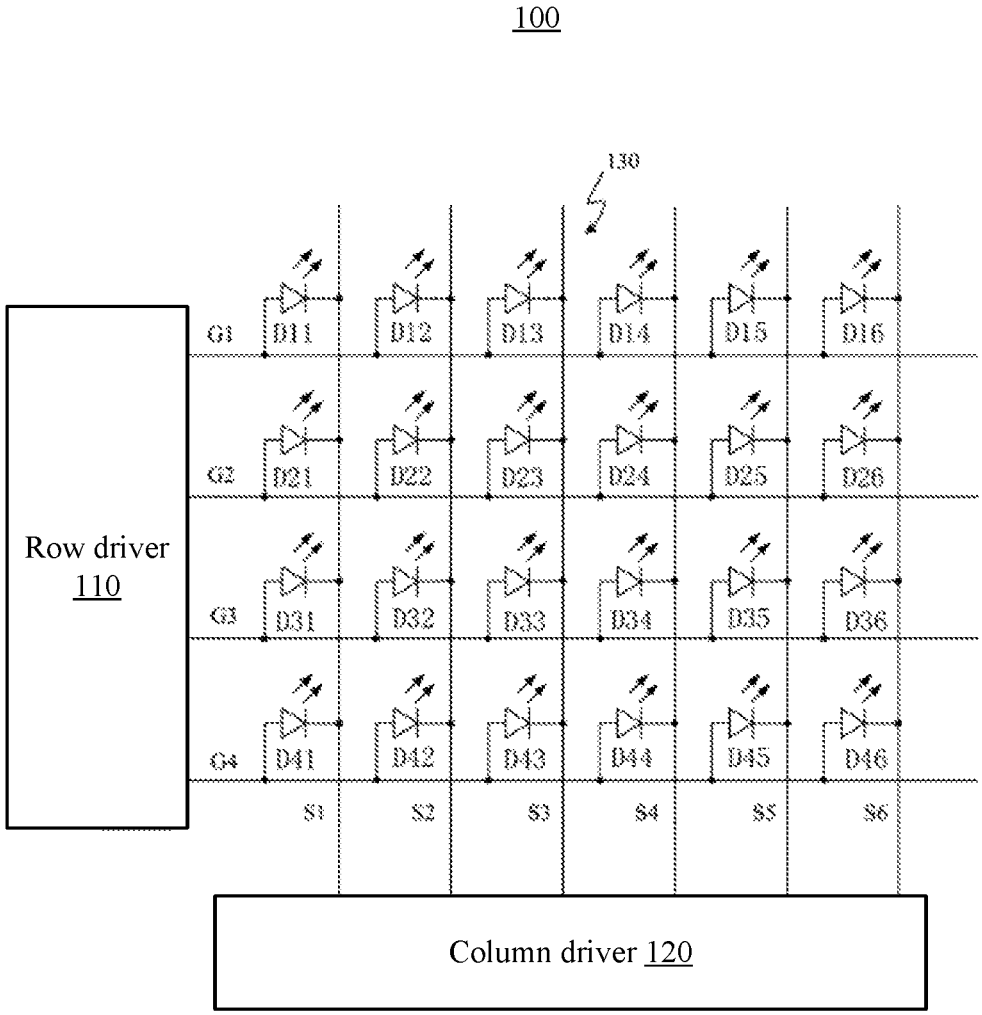
FIG. 2 is a schematic diagram of an LED display unit board according to an embodiment of the disclosure.

FIG. 2 is a schematic diagram of an LED display unit board according to an embodiment of the disclosure. The LED display unit board 100 includes a row driver 110, a column driver 120 and an LED matrix 130.

The LED matrix 130 includes a plurality of LED lamps arranged in rows and columns. As an example, The LED matrix 130 shown in FIG. 2 is a matrix having 4 rows*6 columns. Each of the plurality of LED lamps includes a cathode and an anode, and may be lightened when a forward voltage is applied between the cathode and the anode. The anodes of the plurality of LED lamps in one row are coupled together to a respective row line. For example, the anodes of the LED lamps D11-D16 in a first row are coupled together to the row line G1. The cathodes of the plurality of LED lamps in one column are coupled to a respective column line. For example, the cathodes of the LED lamps D11-D41 in a first column are coupled together to the column line S1.

The row driver 110 is coupled to the plurality of row lines G1-G4, and provides selecting signals. The row driver 110 includes a plurality of selector switches, each of which is coupled to one of the plurality of row lines. When the plurality of selector switches are turned on, the corresponding row lines are coupled to the high potential terminal through the selector switches, respectively.

A column driver 120 is coupled to the plurality of column lines S1 to S6, for adjusting the order of the plurality of subframes in the frame cycle, generating a control signal in accordance with the grayscale data for each pixel, wherein the control signal includes a plurality of subframe signals each having a duration corresponding to a respective subframe display time. In some embodiments, the column driver 120 arranges the plurality of subframes in a predetermined order, e.g. in an ascending order of subframe display time by default. The column driver 120 generates the control signal in the predetermined order in the frame cycle, when the grayscale represented by the grayscale data is equal to or smaller than the first threshold value. The column driver 120 adjusts the order of at least some of the subframes randomly in order to generate the control signal in the adjusted order in the frame cycle, when the grayscale represented by the grayscale data is larger than the first threshold value.

The row driver 120 includes a plurality of constant current sources, each of which is coupled to one of the plurality of row lines. When the row driver 110 selects a plurality of LED lamps in one row, the anodes of the selected plurality of LED lamps are coupled to a high potential, and the cathodes of the selected plurality of LED lamps are coupled to the plurality of constant current sources respectively, such that forward voltages are applied between the anodes and the cathodes of the selected plurality of LED lamps, thereby lightening the plurality of LED lamps.

In the above-described LED display unit board 100, each of the plurality of LED lamps in the LED matrix 130 is used as a pixel unit. It will be understood that each pixel in the LED display device 100 may include one or more pixel units. For example, in the display of color images, three LED lamps can be used to display the red, green, and blue color components, respectively, each of the three LED lamps produces light in corresponding color in accordance with its own light emission characteristics, or produces light in corresponding color through additional filters.

When the LED display unit board 100 displays a dynamic image, the row driver 110 performs, for example, a progressive scan, to couple the row lines to the high voltage level sequentially. Accordingly, constant current is applied to the plurality of LED lamps in the row by the plurality of constant current sources in the column driver 120 respectively. The column driver 120 provides the control signal to the column lines, so that the effective lighting time of the plurality of LED lamps in the current display line is changed to display one pixel line of the image. In a frame cycle, the cumulative effective time of the control signal is consistent with the grayscale data, the reset time periods are included between the successive subframes in the frame cycle, to separate the successive subframes from each other. In each subframe of the frame cycle, the LED lamps acting as the plurality of pixel units corresponding to each of the pixels are turned on or off in accordance with the subframe signals.

In some embodiments, the division of a frame cycle can be performed on each row, that is, a scanning cycle of a display row line is divided into a plurality of subframe display time periods.

Figure 3:
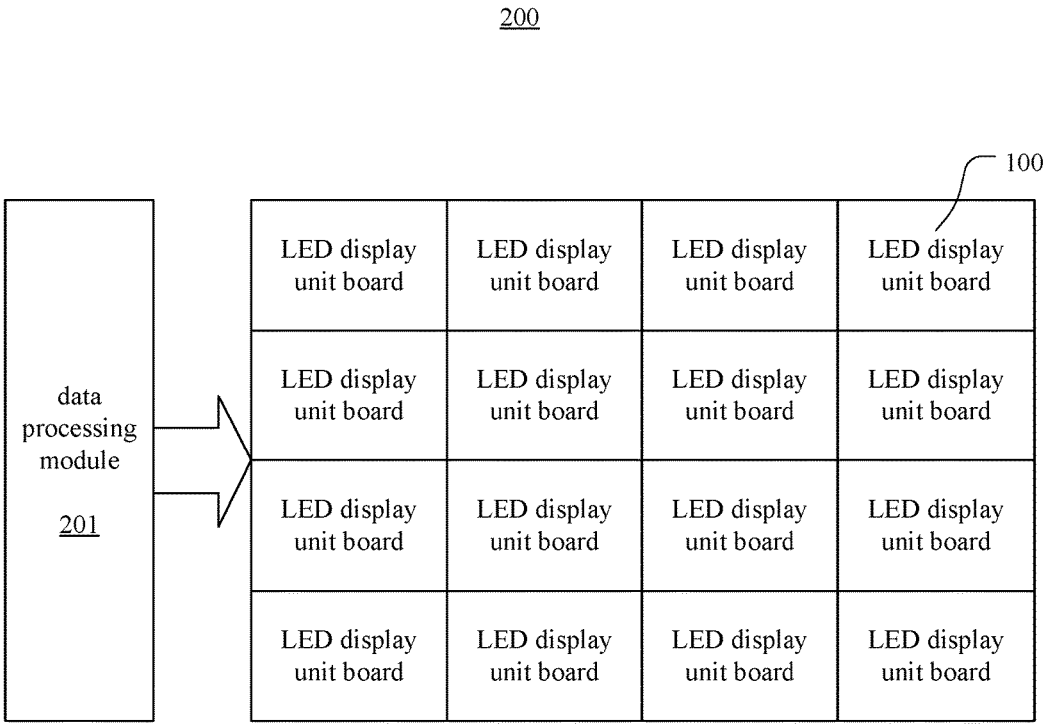
FIG. 3 is a schematic diagram of an LED display device according to an embodiment of the disclosure.

FIG. 3 is a schematic diagram of an LED display device according to an embodiment of the disclosure. The LED display device 200 includes a plurality of LED display unit boards 100 and a data processing module 200. The LED display unit board 100 has been described in detail with reference to FIG. 2, and will not be described again. The number and the arrangement of the LED display unit boards 100 in the LED display device 200 are not limited to those described in FIG. 3, which can be configured according to actual requirements.

The data processing module 201 generates the grayscale data for each pixel in accordance with the image to be displayed.

The plurality of LED display unit boards 100 display an image at a predetermined frame cycle, the frame cycle includes a plurality of subframes, each of the plurality of subframes has a respective subframe display time.

In some embodiments, the data processing module 201 generates indication data in accordance with the grayscale data and combines the indication data and the grayscale data into the display data. The indication data represents the order of at least some of the plurality of subframes. For example, the data processing module 201 further combines the indication data in form of binary value with the grayscale data, the indication data can be implemented as a binary value formed by at least one bit of the display data for indicating various adjusted orders. For example, the indication data can be formed by two least significant digits of the binary value of the display data, the data processing module 201 can instruct the column driver 120 in the LED display unit board 100 to realize four adjusted orders according to the two least significant digits of the display data.

The column driver 120 divides a frame cycle into a plurality of subframe display time periods and a plurality of reset time periods in time domain, the reset time periods separate the successive subframes from each other. Corresponding to the subframe display time, the column driver 120 generates the subframe signals included in the control signal during the subframe display time periods. The column driver 120 also uses the subframe signals to control the constant current sources to provide driving current for lighting the LED lamps. The control signal, which is generated in accordance with the grayscale data, includes the plurality of subframe signals each having a duration corresponding to a respective subframe display time. During the reset time periods, the column driver 120 resets the output signal to a state before the control signal is generated, and the LED lamps are reset during the reset time periods. The above plurality of subframe display time may be different in length in time domain. The order of the control signal of the embodiment has been described in detail with reference to FIG. 4, and will not repeat again.

In the embodiments of the disclosure, by dividing each frame cycle into a plurality of subframes and adjusting the subframe display time, parasitic effects between the LED display unit boards may be eliminated, and thus the color differences between the LED display unit boards may be eliminated.

The steps of the method or algorithm described in connection with the embodiments may be implemented by hardware, software modules executed by a processor, or a combination of the two. The software modules may be stored in random access memory (RAM), memory, read only memory (ROM), electrically programmable ROM, electrically erasable programmable ROM, registers, hard disks, removable disks, CD-ROMs, or other storage medium known in any form and known in the prior art.

It should also be understood that the relational terms such as "first", "second", and the like are used in the context merely for distinguishing one element or operation form the other element or operation, instead of meaning or implying any real relationship or order of these elements or operations. Moreover, the terms "comprise", "comprising" and the like are used to refer to comprise in nonexclusive sense, so that any process, approach, article or apparatus relevant to an element, if follows the terms, means that not only said element listed here, but also those elements not listed explicitly, or those elements inherently included by the process, approach, article or apparatus relevant to said element. If there is no explicit limitation, the wording "comprise a/an . . . " does not exclude the fact that other elements can also be included together with the process, approach, article or apparatus relevant to the element.

Although various embodiments of the present invention are described above, these embodiments neither present all details, nor imply that the present invention is limited to these embodiments. Obviously, many modifications and changes may be made in light of the teaching of the above embodiments. These embodiments are presented and some details are described herein only for explaining the principle of the invention and its actual use, so that one skilled person can practice the present invention and introduce some modifications in light of the invention. The invention is intended to cover alternatives, modifications and equivalents that may be included within the spirit and scope of the invention as defined by the appended claims.

The invention claimed is:

1. A light-emitting diode (LED) display device, comprising:

a module configured to generate a grayscale data in accordance with an image to be displayed; and a plurality of LED display unit boards configured to the display said images at a predetermined frame cycle, wherein said frame cycle comprises a plurality of subframes, each of said plurality of subframes has a respective subframe display time, and each of said LED display unit boards comprises:

a plurality of row lines and a plurality of column lines;

a row driver being coupled to said plurality of row lines, and configured to provide a selecting signal;

a column driver being coupled to said plurality of column lines, and configured to adjust an order of said plurality of subframes in said frame cycle in accordance with said grayscale data and generate a control signal in accordance with said grayscale data, wherein said control signal comprises a plurality of subframe signals each having a duration corresponding to a respective subframe display time; and a plurality of pixel units, wherein each of said plurality of pixel units comprises an LED lamp being coupled to one of said plurality of row lines and one of said plurality of column lines, wherein each LED lamp corresponding to a respective pixel unit is turned on or off in accordance with said plurality of subframe signals, wherein said frame cycle includes a reset time period between successive subframes of said plurality of subframes, wherein said column driver is configured to arrange said plurality of subframes by their subframe display times from the smallest to the largest in a predetermined order by default, wherein said column driver is configured to generate said control signal in said predetermined order in said frame cycle, when a grayscale represented by said grayscale data is equal to or smaller than said first threshold value, and wherein said column driver is configured to adjust the order of at least some of said plurality of subframes randomly to generate said control signal in accordance with an adjusted order, when a grayscale represented by said grayscale data is larger than said first threshold value.

2. The LED display device according to claim 1, wherein said module is further configured to randomly generate an indication data in accordance with said grayscale data, and wherein the indication data represents said order of at least some of said plurality of subframes.

3. The LED display device according to claim 2, wherein said module is further configured to combine said indication data and said grayscale data into a display data, and said indication data is a binary value formed by at least one bit of said display data.

4. The LED display device according to claim 3, wherein said column driver is further configured to obtain various adjusted orders in accordance with said indication data of said display data.

5. The display device according to claim 1, wherein said control signal is a pulse width modulation (PWM) signal.

6. A driving method for a light-emitting diode (LED) display device comprising a plurality of LED display unit boards, wherein each of said plurality of LED display unit boards is configured to display an image at a predetermined frame cycle, said frame cycle comprises a plurality of subframes, and each of said plurality of subframes having a respective subframe display time, the driving method comprising:

generating a grayscale data in accordance with an image to be displayed;

generating a control signal in accordance with said grayscale data, wherein said control signal comprises a plurality of subframe signals, each of said subframe signals having a duration corresponding to a respective subframe display time; and turning on or off LED lamps arranged on each of the display unit boards by use of said plurality of subframe signals in each subframe of said frame cycle, wherein said frame cycle includes a reset time period between successive subframes of said plurality of subframes, and an order of said plurality of subframes in said frame cycle is adjusted in accordance with said grayscale data, wherein said plurality of subframes are arranged by their subframe display times from the smallest to the largest in a predetermined order, wherein when a grayscale represented by said grayscale data is equal to or smaller than a first threshold value, said plurality of subframes arranged in said predetermined order are sequentially displayed in said frame cycle, and wherein when said grayscale represented by said grayscale data is larger than said first threshold value, the order of at least some of said plurality of subframes is adjusted randomly to form said plurality of subframes arranged in an adjusted order.

7. The driving method according to claim 6, further comprising:

generating an indication data randomly in accordance with said grayscale data, wherein said indication data represents the order of at least some of said plurality of subframes.

8. The driving method according to claim 7, wherein said grayscale data and said indication data are combined into a display data by a control terminal.

9. The driving method according to claim 8, wherein said indication data is a binary value formed by at least one bit of said display data for indicating various adjusted orders.

10. The driving method according to claim 6, wherein said control signal is a pulse width modulation (PWM) signal.

11. A non-transitory computer-readable storage medium on which computer instructions for performing said driving method in accordance with claim 6 are stored.

* * * * *